US006568310B2

(12) United States Patent
Morgan

(10) Patent No.: US 6,568,310 B2
(45) Date of Patent: May 27, 2003

(54) LIGHTWEIGHT ARMORED PANELS AND DOORS

(76) Inventor: Timothy W. Morgan, 6521 Beach Dr. SW., Seattle, WA (US) 98136

( * ) Notice: Subject to any disclaimer, the term of this patent is extended or adjusted under 35 U.S.C. 154(b) by 0 days.

(21) Appl. No.: 10/002,584

(22) Filed: Oct. 25, 2001

(65) Prior Publication Data

US 2003/0080248 A1 May 1, 2003

(51) Int. Cl.[7] ..... F41H 5/02

(52) U.S. Cl. ..... 89/36.02; 89/36.01; 89/36.11; 244/118.5; 244/121; 244/129.5

(58) Field of Search ..... 244/118.5, 121, 244/129.5, 133; 109/49.5; 89/36.11, 36.02, 36.01

(56) References Cited

U.S. PATENT DOCUMENTS

| | | | | | |
|---|---|---|---|---|---|
| 3,486,966 | A | * | 12/1969 | Allen et al. | 244/121 |
| 3,575,786 | A | * | 4/1971 | Baker et al. | 109/80 |
| 4,111,097 | A | * | 9/1978 | Lasker | 109/83 |
| 4,404,889 | A | * | 9/1983 | Miguel | 428/118 |
| 4,625,659 | A | | 12/1986 | Saelzer | 109/49.5 |
| 4,732,803 | A | * | 3/1988 | Smith, Jr. | 109/49.5 |
| 5,060,582 | A | | 10/1991 | Salzer | 109/49.5 |
| 5,102,723 | A | * | 4/1992 | Pepin | 244/133 |
| H1061 | H | * | 6/1992 | Rozner et al. | 109/82 |
| 5,200,256 | A | * | 4/1993 | Dunbar | 109/49.5 |
| 5,221,807 | A | * | 6/1993 | Vives | 109/82 |
| 5,349,893 | A | * | 9/1994 | Dunn | 2/2.5 |
| 5,463,929 | A | | 11/1995 | Mejia | 89/36.02 |
| 5,660,021 | A | | 8/1997 | Wolgamot et al. | 52/783.12 |
| 5,808,228 | A | | 9/1998 | Beschle et al. | 89/36.02 |
| 5,983,578 | A | | 11/1999 | Huttie et al. | 52/79.1 |

FOREIGN PATENT DOCUMENTS

| | | | | |
|---|---|---|---|---|
| DE | 2826372 | | 11/1979 | |
| DE | 3232438 | | 3/1984 | |
| GB | 2238283 | A * | 5/1991 | B64C/1/00 |

* cited by examiner

*Primary Examiner*—Charles T. Jordan
*Assistant Examiner*—Gabriel S. Sukman
(74) *Attorney, Agent, or Firm*—Delbert J. Barnard

(57) ABSTRACT

A layer (16, 24) of a mesh or mail material is bonded to the opposite sides of a ballistic layer (14, 22) a bullet resistant composite material. The layer (18, 26) of relatively light-weight body material, e.g. structural honeycomb, is bonded to the outside of each layer (16, 24) of mesh or mail material. A ballistic layer (28) may be provided on the outside of each layer (26) of relatively lightweight body material. Adhesive material secures the layers together to provide a unified panel. The panel may be a part of the door that is between the cockpit of an airplane and the region in the airplane rearwardly of the cockpit.

6 Claims, 2 Drawing Sheets

LIGHTWEIGHT ARMORED PANELS AND DOORS

TECHNICAL FIELD

This invention relates to the provision of lightweight armored barrier panels and doors for use in airplanes and elsewhere. More particularly, it relates to the provision of a lightweight armored panel usable as a door in a wall between the cockpit of an airplane and the cabin region in the airplane immediately rearwardly of the cockpit.

BACKGROUND OF THE INVENTION

There is a need for effectively preventing passenger intrusion into the cockpit of an airplane. Cockpit doors are needed that can withstand various attacks from ballistics, bladed weaponry and battering rams. These same doors must be lightweight enough to make them practical for airplane use. The principal object of the invention is to provide a laminated door panel that provides the protection needed without adding too much weight to the airplane.

Some airlines have proposed some desired requirements for armored cockpit doors. They include the following: (1) the door and frame should not exceed one hundred and sixty five pounds (165 lbs.) in weight, (2) the door panel must be able of withstanding several minutes of ramming by a three hundred pound (300 lb.) person and several minutes of pounding with a two pound (2 lb.) hammer, (3) the door panel must withstand a 9 mm "NIJ 3 A type bullet" and withstand a NATO M26 grenade at a distance of eight inches (8"); and (4) the door panel must be able to withstand repeated blows from an aircraft crash axe. Another object of the present invention is to meet or exceed these requirements.

BRIEF SUMMARY OF THE INVENTION

The present invention includes constructing a composite door from layers in which different layers of different materials are used to protect against ballistic, bladed weaponry and battering ram attacks on the door.

The present invention includes providing a laminated panel having at least one layer of a relatively lightweight body material, at least one layer of bullet resistant composite material, and at least one layer of a mesh or mail material providing blade attack resistance. The layers are bonded together to provide a unified panel. The body material may be selected from the group of materials consisting of honeycomb materials, balsa wood and rigid foam materials. The ballistic layer may be selected from the group of materials consisting of woven Kevlar, Aramid, graphite, polyester, fiberglass or phenolic fiber cloth used with phenolic, epoxy or polyester resins, or as a draped material. The mesh or mail material may be selected from the group of materials consisting of corrosion resistant steel mesh, woven metallic mesh, perforated sheet metal and link-type mail. The bonding material may be a film adhesive material.

The invention includes incorporating the barrier panel into a door that is used in an airplane between the cockpit and the cabin region immediately rearwardly of the cockpit.

In one embodiment, a layer of mesh or mail material, providing blade attack resistance, is positioned between a layer of relatively lightweight body material and a. ballistic layer of bullet resistant composite material.

In another embodiment, a ballistic layer of bullet resistant composite is provided on each side of a layer of a mesh or mail material providing blade attack resistance. The layers of mesh or mail material may be outwardly bounded by layers of relatively lightweight body material.

A layer of a mesh or mail material that provides blade attack resistance may be positioned on each side of a ballistic layer of bullet resistant composite material. A layer of relatively lightweight body material may be positioned outwardly adjacent each layer of the mesh or mail material. Additional ballistic layers of bullet resistant composite material may be provided immediately outwardly adjacent each layer of relatively lightweight body material.

In another embodiment, a ballistic layer of bullet resistant and blade attack resistant composite is positioned between layers of relatively lightweight body material. This is meant to cover a composite material currently available that is both ax-resistant and bullet-resistant.

Other objects, advantages and features of the invention will become apparent from the description of the best mode set for below, from the drawings, from the claims and from the principles that are embodied in the specific structures that are illustrated and described.

BRIEF DESCRIPTION OF THE SEVERAL VIEWS OF THE DRAWING

Like reference numerals refer to like parts throughout the several views of the drawing, and.

DETAILED DESCRIPTION OF THE INVENTION

Figure 1:
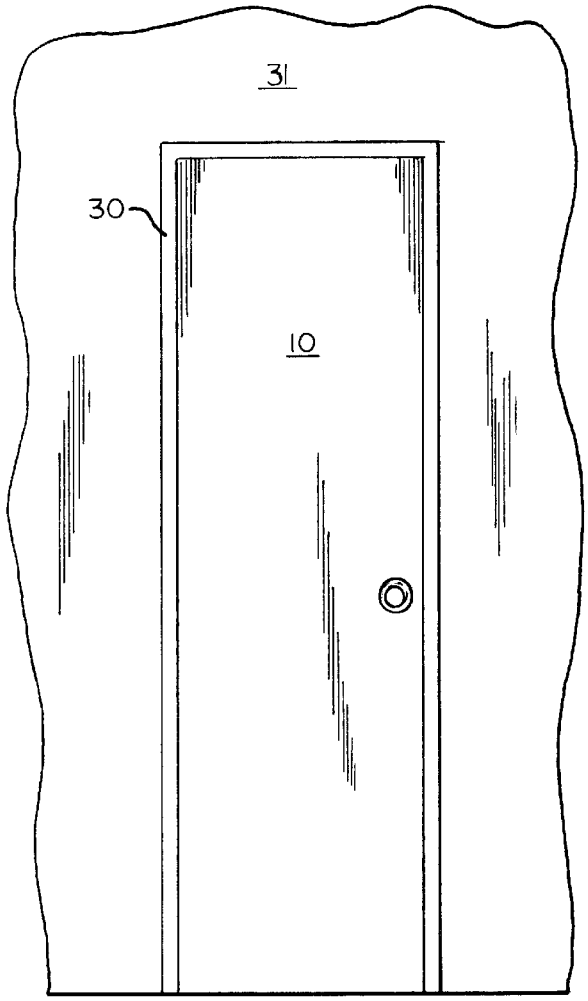
FIG. 1 is a front elevational view of a cockpit door that includes a laminated barrier panel that incorporates the present invention.
Figure 2:
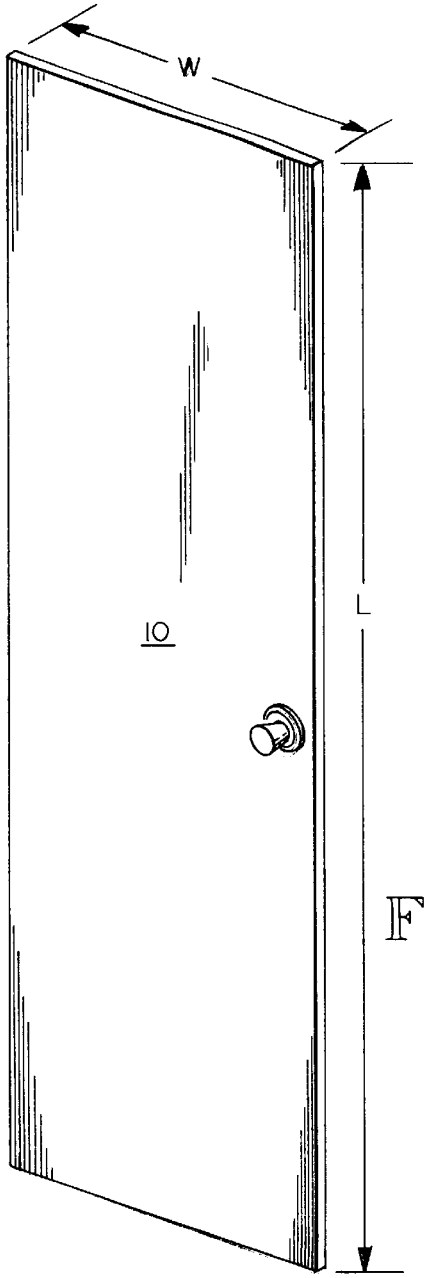
FIG. 2 is a pictorial view of the door shown in FIG. 1, such view being taken from above and looking towards the top, one side and one edge of the door.
Figure 3:
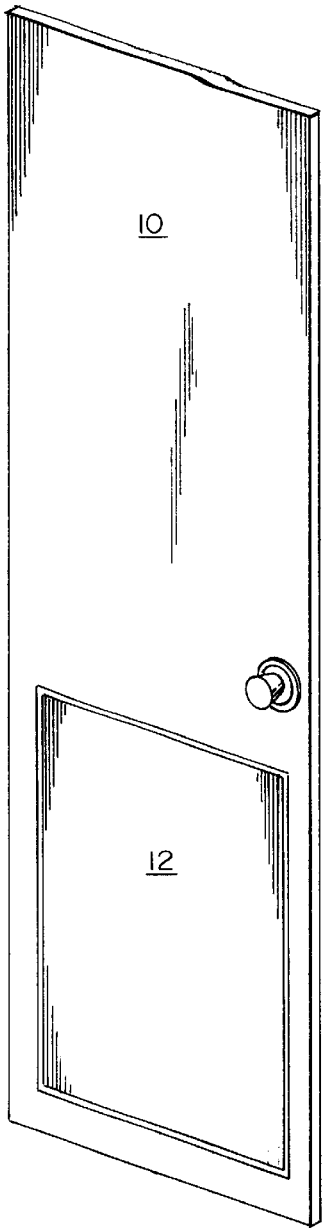
FIG. 3 is a view like FIG. 2 but showing a cockpit door that includes a decompression panel.

FIGS. 1 and 2 show a panel 10 adapted to serve as a door between the cockpit in an airplane and a cabin region in the airplane immediately rearwardly of the cockpit. In FIGS. 1 and 2, the panel 10 is of uniform construction throughout. FIG. 3 shows a modified door construction characterized by a main panel 10' and a smaller decompression panel 12. Both panel 10' and panel 12 incorporate the present invention.

Figure 4:
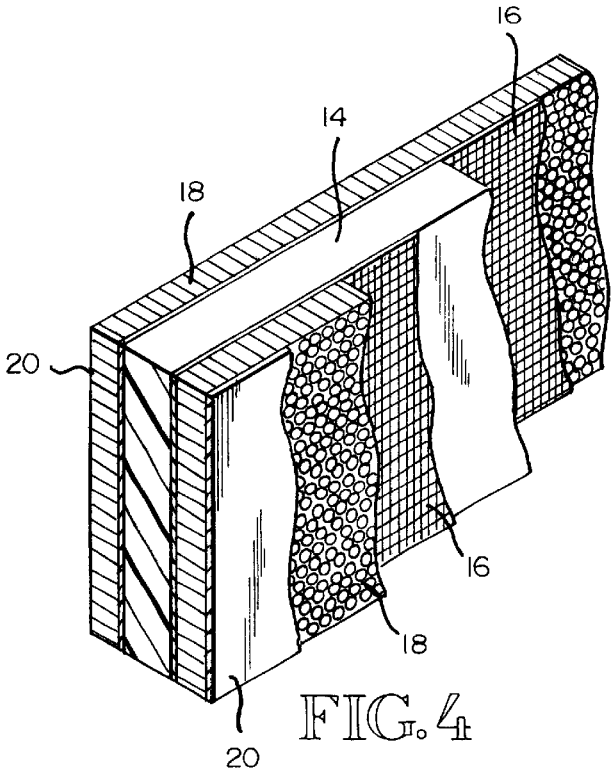
FIG. 4 is a fragmentary pictorial view of a first construction of a laminated barrier panel.

FIG. 4 shows a first construction of the panels 10, 10', 12. It includes a ballistic layer 14 between two layers 16 of a mesh or mail material. A layer 18 of a relatively lightweight body material is positioned outwardly of each mesh or mail layer 16. The outer surfaces of the panels 18 may be covered by one or two ply face sheets 20.

Preferably, a film adhesive is used between adjacent layers to connect them together into a unified panel 10, 10', 12.

Figure 5:
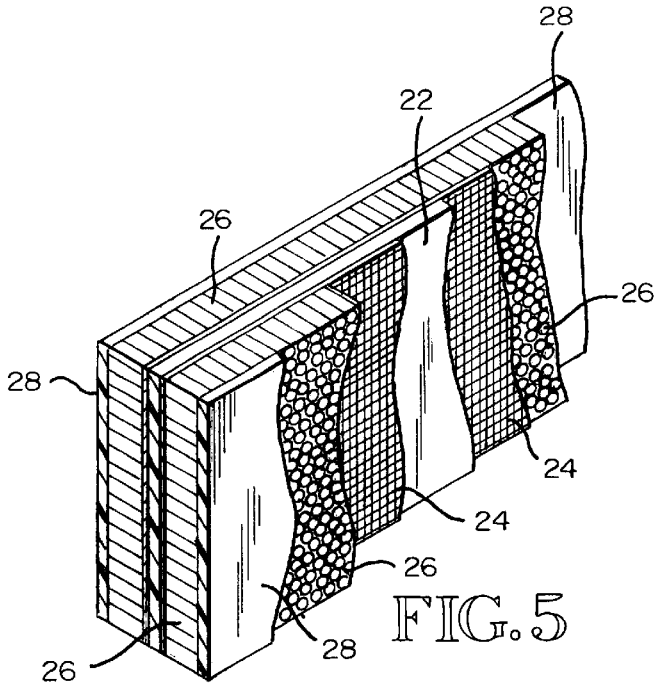
FIG. 5 is a view like FIG. 4 but of a second construction of a laminated barrier panel.

FIG. 5 shows a second construction of the panels 10, 10', 12. It has a ballistic layer 22 at its center that is flanked on each side by a mesh or mail layer 24. There is a layer 26 of the relatively lightweight body material 24 located outwardly of each layer 24. A ballistic layer 28 is provided outwardly of each layer 26. As in the panel construction shown by FIG. 4, the various layers 24, 26, 28 are connected together by a film adhesives or some other suitable adhesive.

The body material 18, 26 may be selected from the group of materials consisting of structural honeycomb, balsa wood and rigid foam. Many years ago, structural honeycomb revolutionized the aerospace industry by substantially reducing weight without compromising strength. Honeycomb comes in various patterns, densities and cell sizes. There is regular, over-expanded and flex-type honeycomb. There are both fire retardant and non-fire retardant honeycomb. Structural honeycombs suitable for use in the barrier panels of the invention include Nomex honeycomb, Kevlar honeycomb, Aramid paper honeycomb, epoxy paper honeycomb and aluminum honeycomb.

Manufacturers of the several lightweight materials include the Hexcel Corporation (see www.hexcelcomposites.com) (e.g. Phenolic coatead, Aramid paper or fiberglass fabric Honeycomb core, e.g. A-1, HRH-10, HDC, HFT, HTP, HMX, KOREX and HRP series cores); Euro-Composites (www.euro-composites.com) (e.g. EC and ECA series cores, e.g. epoxy paper Honeycomb core, EC-PA and EC-PI series sandwich panels); M.C. Gill Corporation (www.gillcorp.com) (e.g. HA and HD series cores); Aerocell Structures, Inc. (www.aerocell.net) (e.g. APH and APX series cores); General Plastics Manufacturing Co. (www.generalplastics.com); Jamco (www.jamco.co) (e.g. NSH series); Baltek Corporation (www.baltek.com); SP Systems (www.spsystems.com); and Showa Aircraft (www.showa-aircraft.co.jp. (No. 600 Tanaka-Machi, Akishima-Shi, Tokyo, 196 Japan); (e.g. SAH series). Other suitable materials for the body panels 18, 26 include balsa wood (e.g. balsa wood core; for example, SuperLite S, D57/CK57, D100/CK100, D150/CK150, AL600 series from Baltek Corp.) and rigid polyurethane foam (e.g. rigid polyurethane foam core; for example FR3720 or FR6720 foam from General Plastics AirLite CK, ET, C71 or Airex R63, R82, KAPEX C51 series PVC, polyurethane and polyetherimide foam from Baltek Corp.

The face sheets 20 may be made from phenolic, epoxy or polyester resin-impregnated fiberglass woven cloth, including styles 120, 181, 220, 7781, 8800 and 2BRK, S-style and E-style, phenolic, epoxy, bismaleimide, polyamide, quartz or polyester resin-impregnated fiberglass woven cloth; pure or hybrid styles of Aramid, carbon, graphite, polyester and fiberglass non-resin or resin impregnated cloth or random weave, such as Baltek Mat TMK series, Coremat XX K, P & W, Coremat XM series from Baltek Corp.; CYLON series from Cytec-Fiberite, in combination with phenolic, epoxy, bismaleimide, cyanate ester or polyester cold cure or Resin Transfer Mold (RTM) resins, such as 2AT, 5833 or PR500 from 3M Co. (www.mmm.com); CYCOM series resins from Cytec-Fiberite; and 1100, 2000, 3000, 5000, 6000, 7000 series aluminum alloys. Other examples are Gillfab 1000, 1100, 1200, 1300, 1500 series phenolic, epoxy, polyester or nylon resins with fiberglass, Aramid or nylon cloth laminates from M.C. Gill Corp., Cytec-Fiberite CPH, SPH and MXB series phenolic resins with fiberglass; plastic alloys; for example, ABS/PVC, Ultem™ and other fire-resistant plastics, and other types of woven fiberglass cloth or chopper gun applied fiberglass. The resins may be cold-cure resins. An example resin is 2AT available from the 3M Company.

The body panel and face sheets can be made from prefabricated panels, such as: Gillfab 4000 and 5000 series panels from phenolic, epoxy, polyester resins with aluminum, graphite, carbon, fiberglass and polyester laminates and phenolic, Aramid, aluminum, balsa, urethane foam core; Baltek DecoLite, Durakote series panels from polyester, epoxy, phenolic or special resins with wood, aluminum, graphite, carbon, fiberglass and polyester laminates and balsa wood or foam cores.

The ballistic layers 14, 22, 28 may be woven Kevlar, Aramid, graphite, carbon ceramic polyester, fiberglass or phenolic fiber cloth used either with phenolic, epoxy or polyester resins, or as a draped or solid material. Other ballistic layers are Gillfab—1094FR polyester E-glass laminate, 1394 phenolic S-2 glass laminate, 1160 Aramid reinforced vinyl ester resin glass laminate from M.C. Gill (manufactured under license from Dow Corning; Spectra Fiber from Honeywell (www.performancefibers.com); Ballistech TL series from Tweraser Enterprises, Inc. (800 E. Cypress Creek Road, Suite 201, Ft. Lauderdale, Fla. 33334); Micarta Brass from International Paper Inc. (304 Hoover St., Hampton, S.C. 29924). Example manufacturers of these materials include M.C. Gill Corp. (www.gillcorp.com); Cytec-Fiberite, (cybond@hg.cytec.com); and Honeywell (www.honeywll.com).

The layers 16, 28 may be made from corrosion resistant steel mesh, other woven metallic mesh, perforated sheet metal or a commercially available link-type mail. The overall open area of the mesh or perforated metal may vary between five percent (5%) to seventy percent (70%) of the material area. Other materials that can be used are woven Kevlar, Aramid, graphite, polyester, fiberglass or phenolic fiber cloth, used either with phenolic, epoxy or polyester resins, or as a draped material. These materials can be obtained from M.C. Gill, Allied Signal, Cytec-Fiberite, Micarta and others.

Film adhesives are preferably used to adhere the various layers into a cured panel. Suitable film adhesives can be obtained from 3M Co., e.g. AF series from 3M Co. The layers 14, 16, 18, 20, 22, 24, 26, 28 and the film adhesives are cured by use of an autoclave, room temperature cure, a press or an oven and vacuum process, to transform the layers into a composite panel of substantially uniform construction throughout.

Weight considerations necessitate using a composite material in place of metal for protecting against a ballistics attack. Phenolic hexagon core material, for example, provides the strength requirements and minimizes weight. The use of pre-impregnated phenolic fiberglass face sheets provides a good finish and desirable decorative characteristics. The ballistic armoring provides a weight increase of approximately thirty-five pounds (35 lbs) over the use of door panels that are not armored.

The design goal for bladed attacks is to not just delay destruction of the door but to eliminate the possibility of complete penetration. To meet this design goal, two layers of the mesh or mail material are incorporated into the panel.

The door 10, 10' may be mounted into a door frame 30 in wall 31 by spring-loaded hinge pins that allow the door 10, 10' to be removed from the cockpit side of the door. The hinge pins are not visible to the main cabin and are constructed to be disengaged without the use of tools. Wall 31 and other panels in the airplane may incorporate the invention.

The following is a description of the presently preferred construction of a laminated barrier panel utilizing the present invention. The face sheets are SPH-2404 L/7781 7781-style Phenolic pre-impregnated fiberglass, manufactured by Cytec-Fiberite. There are two plys of the face sheets per each side of the barrier panel. The body or core material is 0.25 inch thick HRH-10 series ⅛ cell size, 3 pounds per cubic foot, honeycomb core made from phenolic resin and Aramid paper fiber. This material is made by Hexcel Corporation.

There are two bladed armor layers. Each layer is 0.032 inches thick. It is a number 4 woven mesh, made of 300 series corrosion resistant steel. This is a commercially available product. A film adhesive is used to bond the bladed armor layers to the ballistic and body materials. Preferably, the adhesive used is AF-163-2 OST film adhesive manufactured by the 3M Company.

The ballistic material is sold under the trademark MICARTA BRASS. It is a 0.38 inch thick panel of phenolic fiberglass material from International Paper Co., or a 0.38 inch thick Phenolic S-2 Glass sold by M.C. Gill Corp., under license from Owens Corning.

The panel material should be arranged in a symmetrical pattern to maximize panel flatness and avoid warping after curing.

If a decompression panel 12 is utilized, it can also offer a new level of safety by featuring a four-bolt pin latch activated by a pressure sensor. This type of decompression function will also utilize a special toughened urethane seal to prevent attempts at prying the panel opening. An alternative decompression method uses overhead ducting to eliminate the need for a blowout panel 12 in the cockpit door 10'. This method would simplify the door construction and would eliminate a weak link in the armor system. Incorporating a blowout panel into lowered ceiling panel aft of the cockpit door can provide two-way decompression provisions for the cockpit. A hard duct will direct the airflow between the main cabin and an overhead vent in the cockpit. The duct will be sized to eliminate the possibility of human access. To help control airflow between the cockpit and the main cabin, this vent may also contain adjustable louvers.

The door 10, 10' will also require the use of a door latch that is designed to foil unauthorized entry. A new doorframe header and vertical members will be required to ensure ballistic and structural integrity. Secondary structural attachments may also have to be reinforced in both the ceiling and floor. It may also be desirable to provide the door 10, 10' with a bulletproof see-through window. The hinge structure, the doorframe, the window if used, and the door latch are all beyond the scope of this invention. This invention is concerned with a construction of a door panel 10, 10' in a manner that will keep the weight of the door within limits and at the same time protect against a ballistic attack, a ramming attack and a bladed instrument attack.

The armored panel construction of this invention may have use in other parts of the aircraft, and/or in non-aircraft environments.

The illustrated embodiments are only examples of the present invention and, therefore are non-limitive. It is to be understood that many changes in the particular structure, materials and features of the invention may be made without departing from the spirit and scope of the invention. Therefore, it is my intention that my patent rights not be limited to the particular embodiments illustrated and described herein, but rather are to be determined by the following claims, interpreted according to accepted doctrines of claim interpretation, including use of the doctrine of equivalents and reversal of parts.

What is claimed is:

1. A laminated barrier panel, comprising:

a ballistic layer of bullet resistant composite material;

said ballistic layer of bullet resistant composite material being outwardly bounded on each side by a layer of a mesh or mail material providing blade attack resistance;

said layers of mesh or mail material being outwardly bounded by layers of relatively lightweight body material; and adhesive material securing the layers together to provide a unified panel.

2. A laminated barrier panel, comprising:

at least one ballistic layer of bullet resistant composite material;

a layer of a mesh or mail material on each side of said ballistic layer, said layer of a mesh or mail material providing blade attack resistance;

a layer of relatively lightweight body material outwardly adjacent each layer of the mesh or mail material; and adhesive material securing the layers together to provide a unified panel.

3. The laminated barrier panel of claim 2, comprising additional ballistic layers of bullet resistant composite material immediately outwardly adjacent each layer of relatively lightweight body material.

4. In a door that is used in an airplane between the cockpit and the region immediately rearwardly of the cockpit, a laminated barrier panel, comprising:

a ballistic layer of bullet resistant composite material;

said ballistic layer of bullet resistant composite material being outwardly bounded on each side by a layer-of a mesh or mail material providing blade attack resistance;

said layers of mesh or mail material being outwardly bounded by layers of relatively lightweight body material; and adhesive material securing the layers together to provide a unified panel.

5. In a door that is used in an airplane between the cockpit and the region immediately rearwardly of the cockpit, a laminated barrier panel, comprising:

at least one ballistic layer of bullet resistant composite material;

a layer of a mesh or mail material on each side of said ballistic layer, said layer of a mesh or mail material providing blade attack resistance;

a layer of relatively lightweight body material outwardly adjacent each layer of the mesh or mail material; and adhesive material securing the layers together to provide a unified panel.

6. The laminated barrier panel of claim 5, comprising additional ballistic layers of bullet resistant composite material immediately outwardly adjacent each layer of relatively lightweight body material.

* * * * *